US010982881B2

(12) United States Patent
Wofford

(10) Patent No.: US 10,982,881 B2
(45) Date of Patent: Apr. 20, 2021

(54) WATER HEATER FITTING FOR DRAINING A WATER HEATER

(71) Applicant: Craig Wofford, Farmington, MO (US)

(72) Inventor: Craig Wofford, Farmington, MO (US)

( * ) Notice: Subject to any disclaimer, the term of this patent is extended or adjusted under 35 U.S.C. 154(b) by 49 days.

(21) Appl. No.: 16/376,616

(22) Filed: Apr. 5, 2019

(65) Prior Publication Data

US 2020/0318859 A1 Oct. 8, 2020

(51) Int. Cl.
*F24H 9/16* (2006.01)
*F24H 9/20* (2006.01)

(52) U.S. Cl.
CPC ..... *F24H 9/16* (2013.01); *F24H 9/2007* (2013.01)

(58) Field of Classification Search
None
See application file for complete search history.

(56) References Cited

U.S. PATENT DOCUMENTS 4,854,613 A * 8/1989 Reece ..... F16B 39/10 285/39
4,976,004 A 12/1990 Bufford-Thacker
5,152,843 A * 10/1992 McDonald ..... F24H 9/0042 122/379
5,406,935 A 4/1995 Cinotto
5,715,569 A 2/1998 Dickey
6,353,708 B1 * 3/2002 Reusche ..... A01K 7/027 392/455
7,793,679 B2 * 9/2010 Murphy ..... F16K 27/065 137/15.22
8,320,752 B1 11/2012 Bergau
2012/0298143 A1 11/2012 Mai

OTHER PUBLICATIONS

Water heater will not drain, www.waterheatertimer.org/Water-heater-will-not-drain, dated Feb. 25, 2019, pp. 6.
How to Unclog a Drain Valve: 7 Ways to Get the Water Flowing, www.waterheaterleakinginfo.com/unclog-drain-valve, dated Feb. 25, 2019, pp. 8.

* cited by examiner

*Primary Examiner* — Nathaniel Herzfeld
(74) *Attorney, Agent, or Firm* — Stinson LLP

(57) ABSTRACT

A water heater fitting for draining water from a water heater that has a threaded heating element opening configured to threadably receive and support a heating element. The water heater fitting includes a body having opposite first and second ends. The body defines a fluid passage extending between and opening out of the first and second ends. The body includes a water heater connector defining the first end. The water heater connector includes a male threaded portion configured to be threadably received in the threaded heating element opening to form a threaded connection with the threaded heating element opening when the heating element is removed from the threaded heating element opening for draining water out of the water heater.

20 Claims, 4 Drawing Sheets

WATER HEATER FITTING FOR DRAINING A WATER HEATER

FIELD

The present disclosure generally relates to systems and methods for draining a water heater, and, more specifically, to a water heater fitting for draining water from the water heater.

BACKGROUND

Water heaters, such as residential water heaters, require periodic draining for various reasons. In some instances, draining can be complicated if the drain is obstructed. Sediment and/or calcium deposits build up over time inside water heaters and needs to be removed. The sediment and/or calcium deposits are the result of salt, rust or alkaline impurities in the water that settle out of the water and build up along the interior surfaces of the water heater. In order to remove this sediment from the water heater, the water within the water heater is generally drained. The water heater typically includes a drain or drain valve at the bottom of the water heater, which can be opened to allow water to flow out of the water heater. After the water is drained from the water heater, the sediment can be removed. One way to remove the sediment is by removing the heating element and inserting a vacuum into the water heater through the heating element opening, as is generally disclosed in U.S. Pat. No. 5,715,569 and U.S. 2012/0298143. However, in certain circumstances, the build of sediment in the water heater may clog and block the drain, preventing the water from flowing through the drain and out of the water heater. In order to drain the water from the water heater, the drain must first be unclogged.

SUMMARY

In one aspect, a water heater fitting for draining water from a water heater having a threaded heating element opening configured to threadably receive and support a heating element includes a body having opposite first and second ends. The body defines a fluid passage extending between and opening out of the first and second ends. The body includes a water heater connector defining the first end. The water heater connector includes a male threaded portion configured to be threadably received in the threaded heating element opening to form a threaded connection with the threaded heating element opening when the heating element is removed from the threaded heating element opening for draining water out of the water heater.

In another aspect, a water heater assembly includes a water heater having a reservoir for holding water and a drain for draining water from the reservoir. The water heater defines a threaded heating element opening configured to threadably receive and support a heating element for heating water in the reservoir. The water heater assembly also includes a fitting defining a fluid passageway and threaded in the threaded heating element opening such that the fluid passageway is in fluid communication with the reservoir for draining water from the reservoir.

In another aspect, a method of draining water from a reservoir of a water heater includes removing a heating element from an opening of the water heater, installing a water heater fitting in the opening of the water heater previously occupied by the heating element, and draining water out of the water heater through the water heater fitting.

BRIEF DESCRIPTION OF THE DRAWINGS

Corresponding reference characters indicate corresponding parts throughout the drawings.

DETAILED DESCRIPTION

Figure 1:
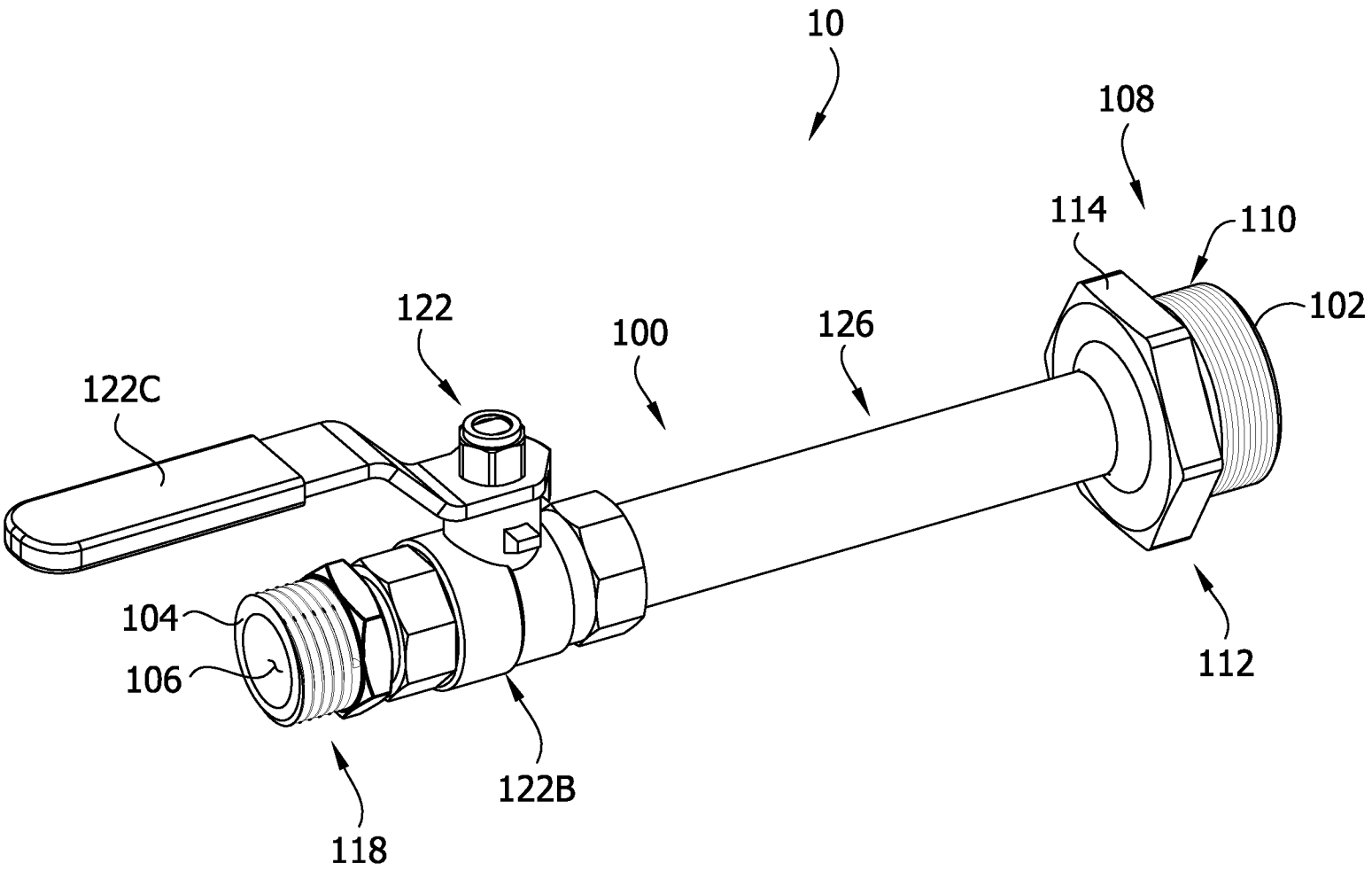
FIG. 1 is a perspective of one embodiment of a water heater fitting of the present disclosure.

Referring to FIGS. 1-4, one embodiment of a water heater fitting is generally indicated at reference numeral 10. The water heater fitting 10 is used for draining water from a water heater, generally indicated at 12. The water heater 12 includes a reservoir 14 defining an interior 16 that holds and stores water (not shown). An inlet pipe 22 supplies water to the water heater 12 and an outlet pipe 24 carries the heated water away from the water heater. A valve 26 (e.g., water shut off valve) is disposed upstream of the water heater 12 on the inlet pipe 22 to selectively shut off (e.g., stop) the supply of water to the water heater. The water heater 12 includes a drain 28 (e.g., a drain valve) connected to the reservoir 14 at the bottom thereof for draining water from the reservoir. The drain 28 can be selectively opened and closed to permit the water in the water heater 12 to flow out of the reservoir 14. As explained in more detail below, the water heater fitting 10 connects to the water heater 12 (broadly, a water heater assembly).

Figure 2:
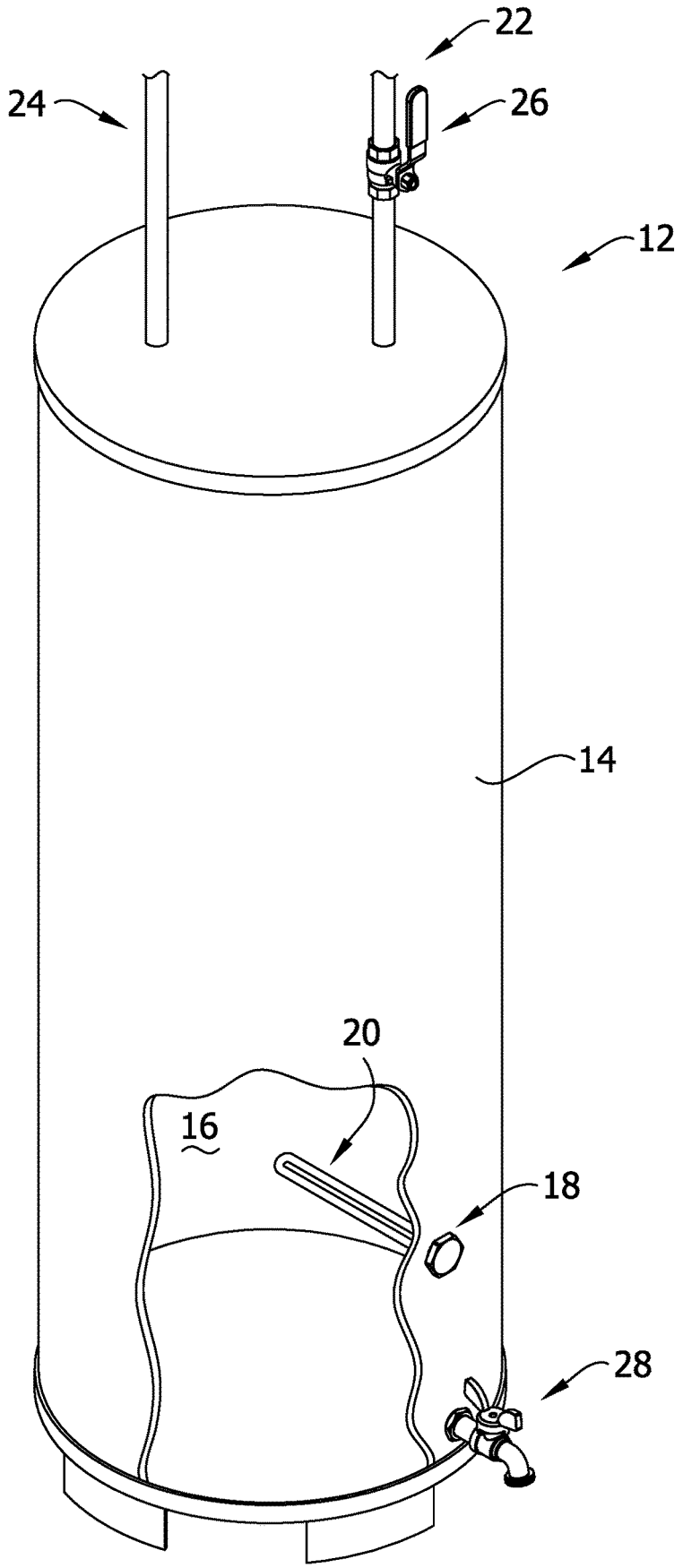
FIG. 2 is a perspective of a water heater with a portion of a tank of the water heater broken away to show a heating element in the interior of the tank.

The reservoir 14 defines a heating element opening 18 that receives and supports a heating element 20. In the illustrated embodiment, the heating element opening 18 is threaded and threadably receives the heating element 20, although other configurations of the heating element opening and heating element are within the scope of the present disclosure. As shown in FIG. 2, the heating element 20 (e.g., at least a portion thereof) is disposed in the interior 16 of the reservoir 14 for heating the water when the heating element is connected to the reservoir. In the illustrated embodiment, the threaded heating element opening 18 includes internal or female 1 inch diameter by 11½ NPSM (National Pipe Straight Mechanical or American National Standard Straight Pipe Thread for Free-Fitting Mechanical Joints) thread and the heating element 20 includes external or male 1 inch diameter by 11½ NPSM thread. A one inch diameter by 11½/NPSM thread is a typical thread size used in water heaters were the heating element is threadably connected to the reservoir. However, the threads of the threaded heating element opening 18 and heating element 20 can have other configurations and constructions (e.g., different diameter with the same type or different type of thread) without departing from the scope of the present disclosure. As explained in more detail below, after the heating element 20 is removed, the water heater fitting 10 is threadably received in the threaded heating element opening 18 to facilitate the unclogging of the drain 28 and to drain the water from the water heater.

Referring to FIG. 1, the water heater fitting 10 has a body 100 having opposite first and second ends 102 and 104, respectively. The body 100 of the water heater fitting 10 defines a fluid passage 106 extending between and opening out of the first and second ends 102, 104 (e.g., first and second ends of the fluid passage are open). The body 100 of the water heater fitting 10 includes a water heater connector 108 at and defining the first end. The water heater connector 108 is configured to connect the water heater fitting 10 to the water heater 12 by securing the water heater fitting to the same opening 18 used to mount the heating element 20 to the water heater. Thus, the water heater connector 108 is configured to mount to the water heater 12 in the same manner as the heating element 20. In one embodiment, the water heater connector 108 is threaded in the heating element opening 18 thereby forming the threaded connection (FIG. 4) with the water heater 12. When the water heater connector 108 is attached or mounted to the water heater 12, the fluid passage 106 is in fluid communication with the interior 16 of the reservoir 14.

Figure 4:
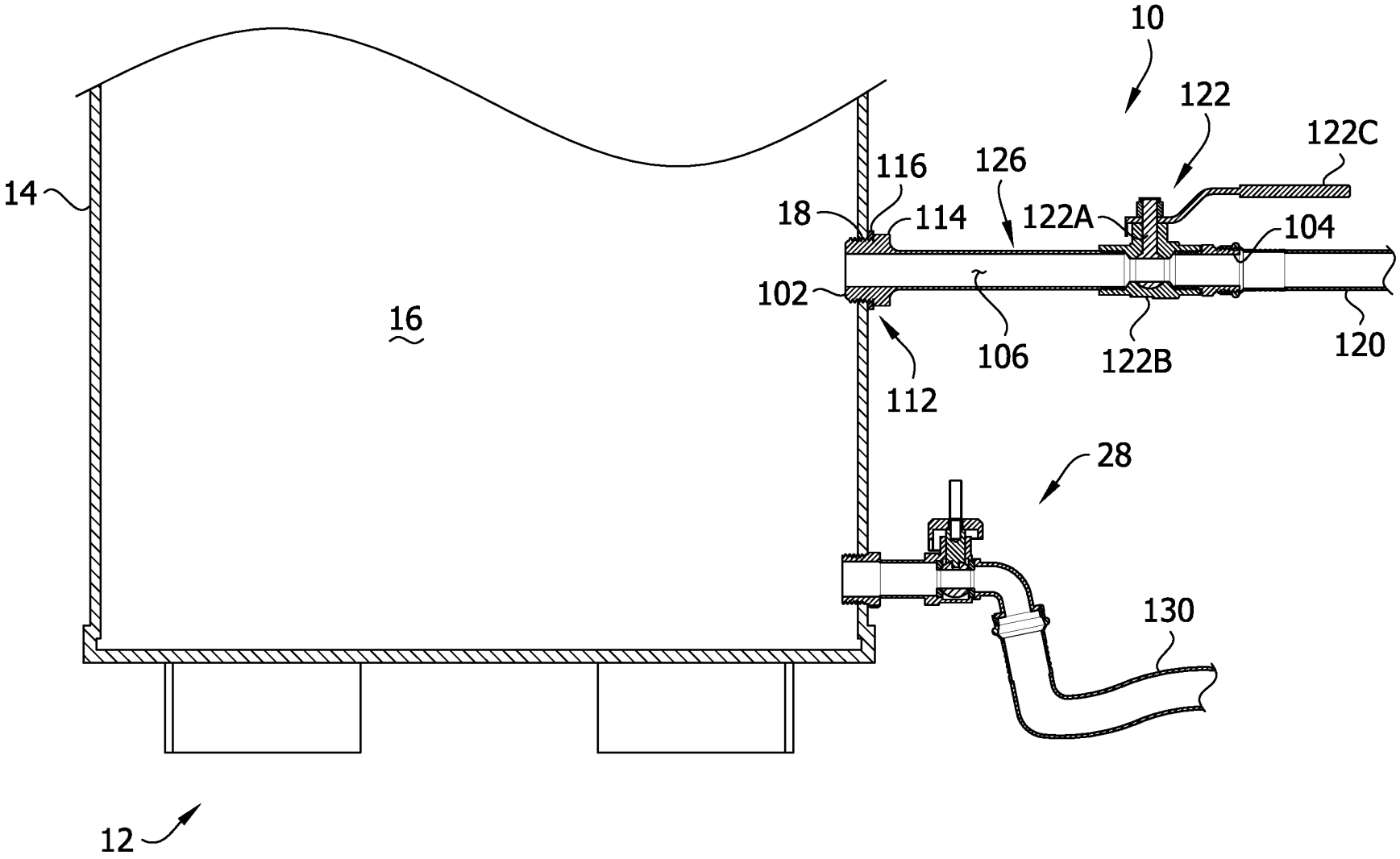
FIG. 4 is an enlarged, cross-sectional view taken through line 4-4 in FIG. 3.

In the illustrated embodiment, the water heater connector 108 includes a male threaded portion 110 configured to be threadably received in the threaded heating element opening 18 of the water heater 12. As shown in FIG. 4, the threaded portion 110 of the water heater connector 108 forms a threaded connection with the threaded heating element opening 18 when the heating element 20 is removed from the threaded heating element opening for draining water out of the water heater 12. The threaded portion 110 is configured to be attached to the water heater 12 by being inserted into the threaded heating element opening 18. The threaded portion 110 includes a thread that corresponds to or matches the thread of the heating element opening 18. In the illustrated embodiment, the threaded portion 110 includes a male 1 inch diameter by 11½ NPSM thread. The threaded portion 110 can have other configurations and constructions without departing from the scope of the present disclosure.

Desirably, the water heater connector 108 is configured to form a fluid tight seal with the heating element opening 18 when the water heater connector is threadably received in the heating element opening to form the threaded connection. In one embodiment, the water heater connector 108 includes a seal 112 (FIG. 4) configured to engage the water heater 12 (specifically the reservoir 14) to form a fluid tight seal with the water heater. The seal 112 includes a flange 114 configured to limit the threading of the threaded portion 110 into the heating element opening 18. The flange 114 is circumferential and extends radially outward (in all directions) from the water heater connector 108. The seal 112 may further include a gasket 116 arranged to be pressed against the water heater 12 by the flange 114 when the threaded connection is formed (FIG. 4). The pressing engagement of the gasket 116 with the water heater 12 by the flange 114 creates the fluid tight seal between the water heater connector 108 (broadly, the water heater fitting 10) and the water heater 12. The engagement between the flange 114, the gasket 116 and the water heater 12 limits the threading of the threaded portion 110 into the heating element opening 18. In one embodiment, the gasket is resiliently compressible. For example, the gasket may be made of rubber or any other suitable material.

Figure 3:
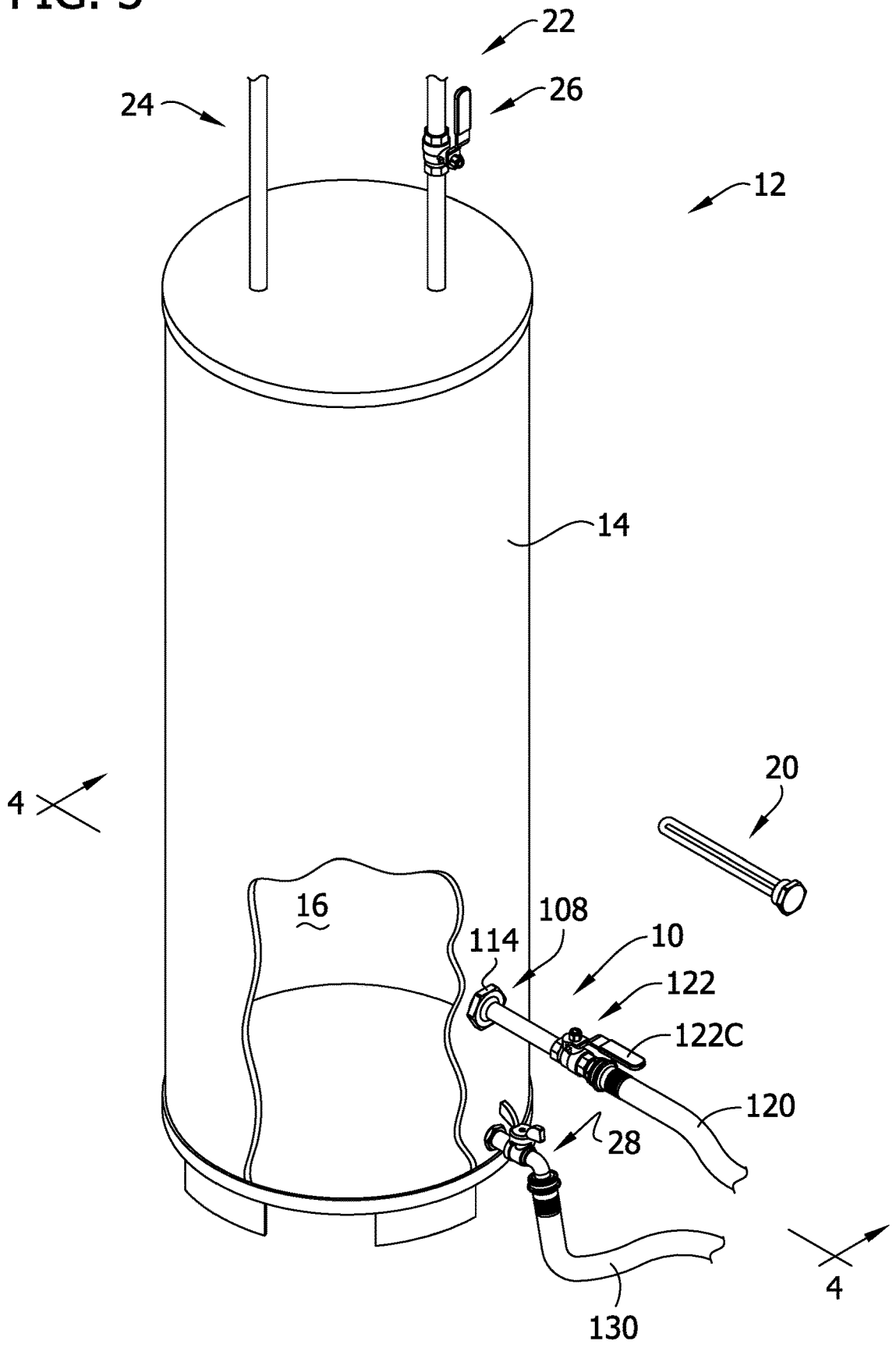
FIG. 3 is similar to FIG. 2, with the heating element removed from the tank and the water heater fitting attached to the tank.

Referring to FIG. 1, the body 100 of the water heater fitting 10 includes a hose connector 118 at and defining the second end 104. The hose connector 118 is configured to connect to a hose 120 (FIG. 3). In one embodiment, the hose connector 118 is a male threaded connector configured to threadably connect to a corresponding female threaded connector of the hose 120. When the water heater connector 108 is attached to the water heater 12 and the hose 120 is attached to the hose connector 118, the hose is in fluid communication with (e.g., fluidly connected to) the interior 16 of the reservoir 14 via the fluid passage 106. As explained in more detail below, the hose 120 receives water from the water heater, via the water heater fitting 10, and directs the water to a location remote of the water heater, such as a drain.

The body 100 of the water heater fitting 10 may also include a valve 122 to open and close the fluid passage 106. The valve 122 is disposed between the first and second ends 102, 104 of the body 100. In other words, the valve 122 is disposed between the water heater connector 108 and the hose connector 118. The valve 122 may include a valve member 122A configured to be selectively actuated to open and close the fluid passage 106. The valve member 122A is movable in a valve housing 122B to open and close the valve 122. A valve actuator 122C is connected to the valve member 122A for moving the valve member. In the illustrated embodiment, the valve actuator 122A comprises a lever. As shown in FIG. 4, when the valve 122 is open, the first and second ends of the fluid passage 106 are fluidly connected (e.g., the fluid passage is open) such that the interior 16 of the reservoir 14 is in fluid communication with the hose 120. Closing the valve 122 (not shown) fluidly disconnects the first and second ends of the fluid passage 106 (e.g., the fluid passage is closed) such that the interior 16 of the reservoir 14 and the hose 120 are not in fluid communication with one another. In the illustrated embodiment, the valve 122 is a ball valve. The valve 122 can have other configurations and constructions without departing from the scope of the present disclosure.

The water heater connector 108, hose connector 118 and valve 122 each define a respective portion of the fluid passage 106. The water heater connector 108 includes neck 126 extending from the threaded portion 110. Both the threaded portion 110 and the neck 126 defines a portion of the fluid passage 106. The valve housing 122B has opposite first and second valve housing ends and defines a portion of the fluid passage 106. The first end of the valve housing 122B is connected to the neck 126. In the illustrated embodiment, the first end of the valve housing and the neck 126 are threadably connected together. The first end of the valve housing includes a female thread that threadably receives a male thread of the neck 126. The second end of the valve housing 122B is connected to the hose connector 118. In the illustrated embodiment, the second end of the valve housing 122B and hose connector 118 are threadably connected together. The second end of the valve housing 122B includes a female thread that threadably receives a male thread of the neck 126. In the illustrated embodiment, the hose connector 118 is a threaded male adapter fitting with a first threaded portion that connects to the second end of the valve housing 122B and a second threaded portion that defines the second end 104 of the body 100 and is configured to connect to the hose 120. In the illustrated embodiment, the water heater connector 108, hose connector 118 and valve 122 are each separate components that are formed separately and connected together. The water heater connector 108, hose connector 118 and/or valve 122 may have other configurations and constructions without departing from the scope of the present disclosure. For example, in one embodiment, the water heart connector 108, hose connector 118 and/or valve 122 may be an integral, one-piece component.

Referring to FIGS. 2-4, the water heater fitting 10 is used to facilitate the unclogging of the drain 28 by draining water from the water heater 12. To use the water heater fitting 10, first the heating element 20 is removed (e.g., unthreaded) from the heating element opening 18 of the water heater. In one embodiment, before removing the heating element 20 from the water heater 12, the valve 26 is closed to create a vacuum in the reservoir 14 by shutting off the supply of water to the water heater. The vacuum reduces the amount of water that spills out of the heating element opening 18 when the heating element 20 is removed. Next, the water heater fitting 10 is installed or mounted to the water heater 12 using the same heating element opening 18 previously occupied by the heating element 20. Specifically, the threaded portion 110 of the water heater connector 108 is threaded in the threaded heating element opening 18. The threaded portion 110 is threaded in the heating element opening 18 until the seal 112 forms a fluid tight fit with the reservoir 14 of the water heater.

To unclog the drain 28 by removing or dislodging the sediment and/or calcium deposits buildup within the drain, a hose 130 (e.g., water supply hose) is connected to the drain 28 (FIG. 3). The hose 130 may be a typical garden hose and is connected to a pressurized source of water (e.g., faucet, spout, spigot, etc.) at the other end. The hose 120 is connected to the water heater fitting 10, via the hose connector 118. The hose 120 directs the water from the water heater 12 to a location set by the user, such as a floor drain in a building. The hose 120 may be connected to the water heater fitting 10 before or after the fitting is attached to the water heater fitting. Once the water heater fitting 10 is connected to the water heater 12 and the hoses 120, 130 are connected to the water heater fitting and drain 28, respectively, the valve on the drain is opened and the valve 122 of the water heater fitting 10 is opened. The user then opens the pressurized source of water. The water is directed through hose 130 and into the drain 28 of the water heater 10. As the water flows into the drain 28, the water breaks up the sediment and/or calcium deposits in the drain and/or reservoir 14, due to the pressure of the water. The water heater fitting 10 is used to for draining water out of the water heater 12. Specifically, the water heater fitting 10 drains at least a portion of the water initially contained within the reservoir 14 and at least a portion of the water flowing through the drain 28 and into the reservoir. The fluid passageway 106 of the water heater fitting 10 provides fluid communication between the interior 16 of the reservoir 14 and the hose 120 to permit the water to flow out of (e.g., drain from) the water heater 12 and into the hose. This prevents a buildup of pressure in the interior 16 of the reservoir 14 that would otherwise occur from directing water through the drain 28 into the reservoir with hose 130, which could possibly prevent the drain 28 from becoming unclogged. As the water is drained out of the water heater 12 through the water heater fitting 10, some if not most of the sediment and/or calcium deposits may also flow or pass through the water heater fitting. Some if not most of the sediment and/or calcium deposits will be agitated by the flow of water through the drain 28 and be carried by the water as it flows out of the water heater fitting 10 and into hose 120.

It is understood that the water heater fitting 10 may be used in other situations for draining the water from the water heater 12. For example, the water heater fitting 10 can be attached to the water heater 12 to provide access to the water held within the reservoir 14 during emergency situations.

Modifications and variations of the disclosed embodiments are possible without departing from the scope of the invention defined in the appended claims. For example, where specific dimensions are given, it will be understood that they are exemplary only and other dimensions are possible.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A water heater fitting for draining water from a water heater having a threaded heating element opening configured to threadably receive and support a heating element, the water heater fitting comprising:

a body having opposite first and second ends, the body defining a fluid passage extending between and opening out of the first and second ends, the body including a water heater connector defining the first end, the water heater connector including a male threaded portion configured to be threadably received in the threaded heating element opening to form a threaded connection with the threaded heating element opening when the heating element is removed from the threaded heating element opening for draining water out of the water heater.

2. The water heater fitting of claim 1, wherein the male threaded portion includes a one inch diameter by 11½ thread.

3. The water heater fitting of claim 1, wherein the water heater connector is configured to form a fluid tight seal with the heating element opening when the water heater connector is threadably received in the heating element opening to form the threaded connection.

4. The water heater fitting of claim 3, wherein the water heater connector includes a seal configured to engage the water heater to form the fluid tight seal with the water heater.

5. The water heater fitting of claim 4, wherein the seal includes a circumferential flange configured to limit threading of the male threaded portion into the heating element opening.

6. The water heater fitting of claim 5, wherein the seal comprises a gasket arranged to be pressed against the water heater by the circumferential flange when the threaded connection is formed.

7. The water heater fitting of claim 6, wherein the gasket is resiliently compressible.

8. The water heater fitting of claim 1, in combination with the water heater, wherein the water heater connector is threaded in the heating element opening thereby forming the threaded connection.

9. The water heater fitting of claim 1, wherein the body includes a hose connector at the second end configured to connect to a hose.

10. The water heater fitting of claim 9, wherein the hose connector is a threaded male connector.

11. The water heater fitting of claim 10, in combination with a hose connected to the threaded male connector.

12. The water heater fitting of claim 1, wherein the body comprises a valve including a valve member configured to be selectively actuated to open and close the fluid passage.

13. The water heater fitting of claim 12, further comprising a hose connector defining the second end, the hose connector configured to connect to a hose for receiving water from the body, wherein the hose connector, the valve, and the water heater connector are formed separately and connected to each other, the water heater connector including a neck extending from the male threaded portion, the valve including a valve housing having a first valve housing end connected to the neck and having a second valve housing end opposite the first valve housing end, the second valve housing end connected to the hose connector, the hose connector, valve, and water heater connector each defining a respective portion of the fluid passage.

14. A water heater assembly comprising:

a water heater including a reservoir for holding water, a drain for draining water from the reservoir, and a threaded heating element opening configured to threadably receive and support a heating element for heating water in the reservoir; and a fitting defining a fluid passageway and threaded in the threaded heating element opening when the heating element is removed from the threaded heating element opening such that the fluid passageway is in fluid communication with the reservoir for draining water from the reservoir.

15. The water heater assembly of claim 14, wherein the heating element opening comprises a female one inch diameter by 11½ thread, and the fitting comprises a male one inch diameter by 11½ threaded portion threaded into the heating element opening.

16. The water heater assembly of claim 14, wherein the fitting further includes a valve configured to be selectively actuated to open and close the fluid passageway and a hose connector configured to connect to a hose.

17. The water heater assembly of claim 16, wherein the fitting further includes a seal engaging the water heater and forming a fluid tight seal between the fitting and the water heater.

18. A method of draining water from a reservoir of a water heater, the method comprising:

removing a heating element from an opening of the water heater, the water heater including a drain;

installing a water heater fitting in the opening of the water heater previously occupied by the heating element; and draining water out of the water heater through the water heater fitting.

19. The method of claim 18, further comprising creating, before removing the heating element, a vacuum in the reservoir by shutting off the water to the water heater.

20. The method of claim 18, further comprising directing fluid into the drain of the water heater to break up sediment or calcium deposits in the reservoir, and wherein draining water out of the water heater through the fitting comprises passing the sediment or calcium deposits through the water heater fitting.

* * * * *